US005895095A

United States Patent [19]

Chen

[11] Patent Number: 5,895,095

[45] Date of Patent: Apr. 20, 1999

[54] ADJUSTABLE ARMREST ASSEMBLIES FOR CHAIRS

[76] Inventor: Su-Jan Chen, No. 200, Lane 545, Section 1, Yang Shing Road, Wu Chi Town, Taichung, Taiwan

[21] Appl. No.: 08/939,405

[22] Filed: Sep. 29, 1997

[51] Int. Cl.[6] ..... A47C 7/54

[52] U.S. Cl. ..... 297/411.36; 297/411.37; 297/411.38

[58] Field of Search ..... 297/411.36, 411.37, 297/411.38, 411.35, 411.3, 411.31, 411.2

[56] References Cited

U.S. PATENT DOCUMENTS

| | | | |
|---|---|---|---|
| 5,318,347 | 6/1994 | Tseng | 297/411.36 |
| 5,324,096 | 6/1994 | Schultz | 297/411.36 |
| 5,435,626 | 7/1995 | Lai | 297/411.36 |
| 5,439,267 | 8/1995 | Peterson et al. | 297/411.36 |
| 5,484,187 | 1/1996 | Doerner et al. | 297/411.36 X |
| 5,590,934 | 1/1997 | Gibbs | 297/411.35 X |
| 5,641,203 | 6/1997 | Van De Riet et al. | 297/411.36 |

FOREIGN PATENT DOCUMENTS

| | | | |
|---|---|---|---|
| 636223 | 11/1992 | Australia | 297/411.36 |

*Primary Examiner*—Laurie K. Cranmer
*Attorney, Agent, or Firm*—Charles E. Baxley, Esq.

[57] ABSTRACT

An armrest assembly includes a base having a lower end secured to the chair and an upper end, a vertical post mounted to the upper end of the base and adjustable in a vertical direction relative to the upper end of the base, the vertical post including a guide pin mounted thereto, and an armrest securely attached to the vertical post to move therewith in the vertical direction. The armrest includes an elongated slot defined therein through which the guide pin extends. The elongated slot extends in a horizontal direction at an angle with a longitudinal axis of the armrest, whereby a sliding movement of the armrest relative to the vertical post causes the armrest to move in a longitudinal direction and a transverse direction on a horizontal plane on which the armrest locates.

9 Claims, 9 Drawing Sheets

ADJUSTABLE ARMREST ASSEMBLIES FOR CHAIRS

BACKGROUND OF THE INVENTION

1. Field of the Invention

The present invention relates to adjustable armrest assemblies for chairs which are adjustable in the height and horizontal position.

2. Description of the Related Art

Chairs are widely used in daily lives and many of them are equipped with armrests. Nevertheless, the chair armrests are generally fixed and thus cannot be adjusted responsive to different body sizes of the user. The present invention aims to provide an adjustable armrest assembly for chairs to solve this problem.

SUMMARY OF THE INVENTION

In accordance with one aspect of the invention, an armrest assembly comprises a base including a lower end secured to the chair and an upper end, a vertical post mounted to the upper end of the base and adjustable in a vertical direction relative to the upper end of the base, the vertical post comprising at least one guide pin mounted thereto, and an armrest securely attached to the vertical post to move therewith in the vertical direction. The armrest includes at least one elongated slot defined therein through which the guide pin extends. The elongated slot extends in a horizontal direction at an angle with a longitudinal axis of the armrest, whereby a sliding movement of the armrest relative to the vertical post causes the armrest to move in a longitudinal direction and a transverse direction on a horizontal plane on which the armrest locates.

In a preferred embodiment of the invention, the elongated slot is inclined. The vertical post includes a slot defined in a top side thereof, and the guide pin is slidably extended through the slot. A spring plate is mounted on the top side of the vertical post and includes at least two positions for releasably engaging with the guide pin. When the guide pin is retained in one of said at least two positions, a maximum displacement in the transverse direction of the armrest during movement of the armrest relative to the vertical post is different from that of the armrest when the guide pin is retained in the other of said at least two positions.

The upper end of the base includes a plurality of vertically spaced engaging grooves defined therein, and the vertical post includes a pin mounted therein for releasably engaging with one of said plurality of engaging grooves, and a control means is provided to actuate the pin to disengage from the engaging grooves. In a preferred embodiment of the invention, the vertical post includes a pair of horizontal plates which together define a space therebetween. Each plate includes a slot defined therein through which the upper end of the base extends. The control member includes a button mounted outside the vertical post for manual operation and a pair of walls projecting from the button into the space. Each wall has a cavity defined in a distal end thereof for receiving the pin, and a spring is provided to bias the pin to engage with one of the engaging grooves. A U-shaped member is mounted in the space, the pin is transversely extended through the U-shaped member to move therewith, and the spring is attached between the U-shaped member and an inner periphery of the vertical post. In an embodiment of the invention, the vertical post includes two half post pieces which are secured together, and the horizontal plates are provided on an inner side of one of the two half post pieces. Preferably, the vertical post comprises an outer sleeve attached to a lower end thereof.

In accordance with another aspect of the invention, an armrest assembly for a chair comprises a base including a lower end secured to the chair and an upper end, the upper end of the base including a plurality of vertically spaced engaging grooves defined therein. A vertical post is mounted to the upper end of the base and adjustable in a vertical direction relative to the upper end of the base. The vertical post includes a pair of horizontal plates which together define a space therebetween. Each plate includes a slot defined therein through which the upper end of the base extends.

A control member includes a button mounted outside the vertical post for manual operation and a pair of walls projecting from the button into the space. Each wall has a cavity defined in a distal end thereof for receiving a pin. A U-shaped member is mounted in the space, and the pin is transversely extended through the U-shaped member to move therewith. A spring is attached between the U-shaped member and the vertical post to bias the pin to engage with one of the engaging grooves. An armrest is securely attached to the vertical post to move therewith in the vertical direction. The pin is disengaged from the engaging grooves to allow vertical movements of the vertical post and the armrest relative to the base when the button is pressed.

Other objects, advantages, and novel features of the invention will become more apparent from the following detailed description when taken in conjunction with the accompanying drawings.

DESCRIPTION OF THE PREFERRED EMBODIMENTS

Figure 1:
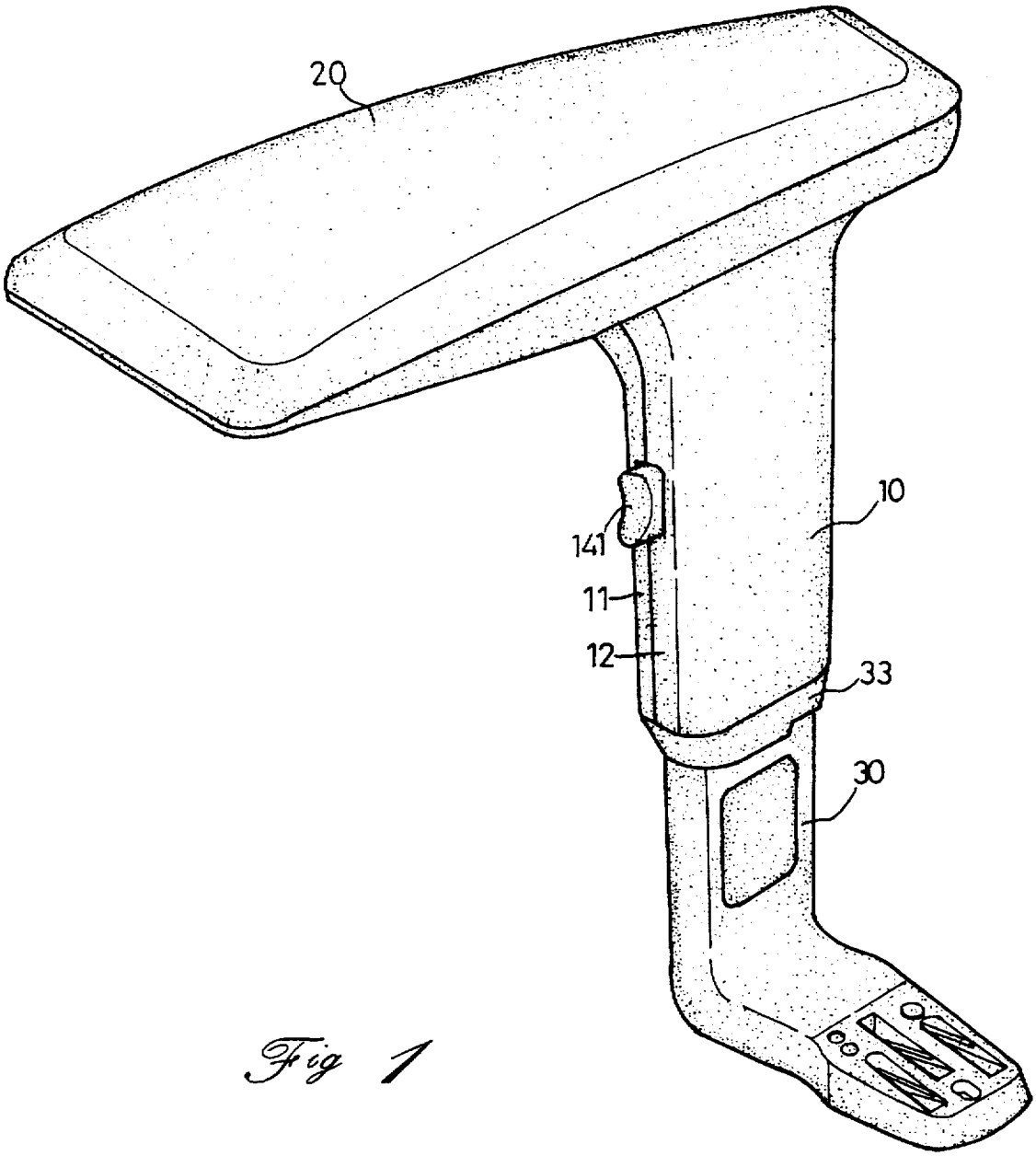
FIG. 1 is a perspective view of a chair armrest assembly in accordance with the present invention.
Figure 2:
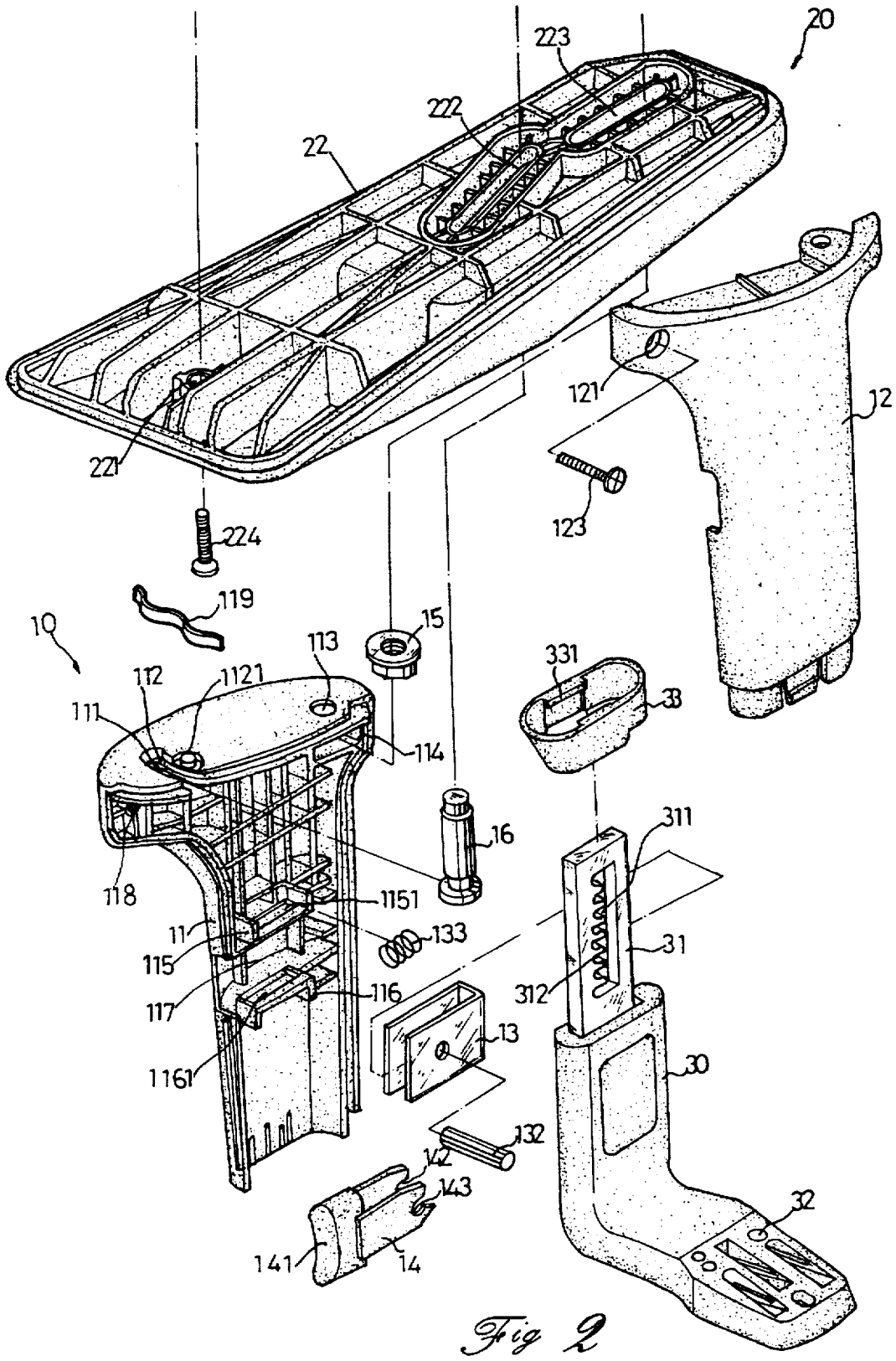
FIG. 2 is an exploded perspective view of the chair armrest assembly in accordance with the present invention, wherein an upper lid is removed for clarity.
Figure 3:
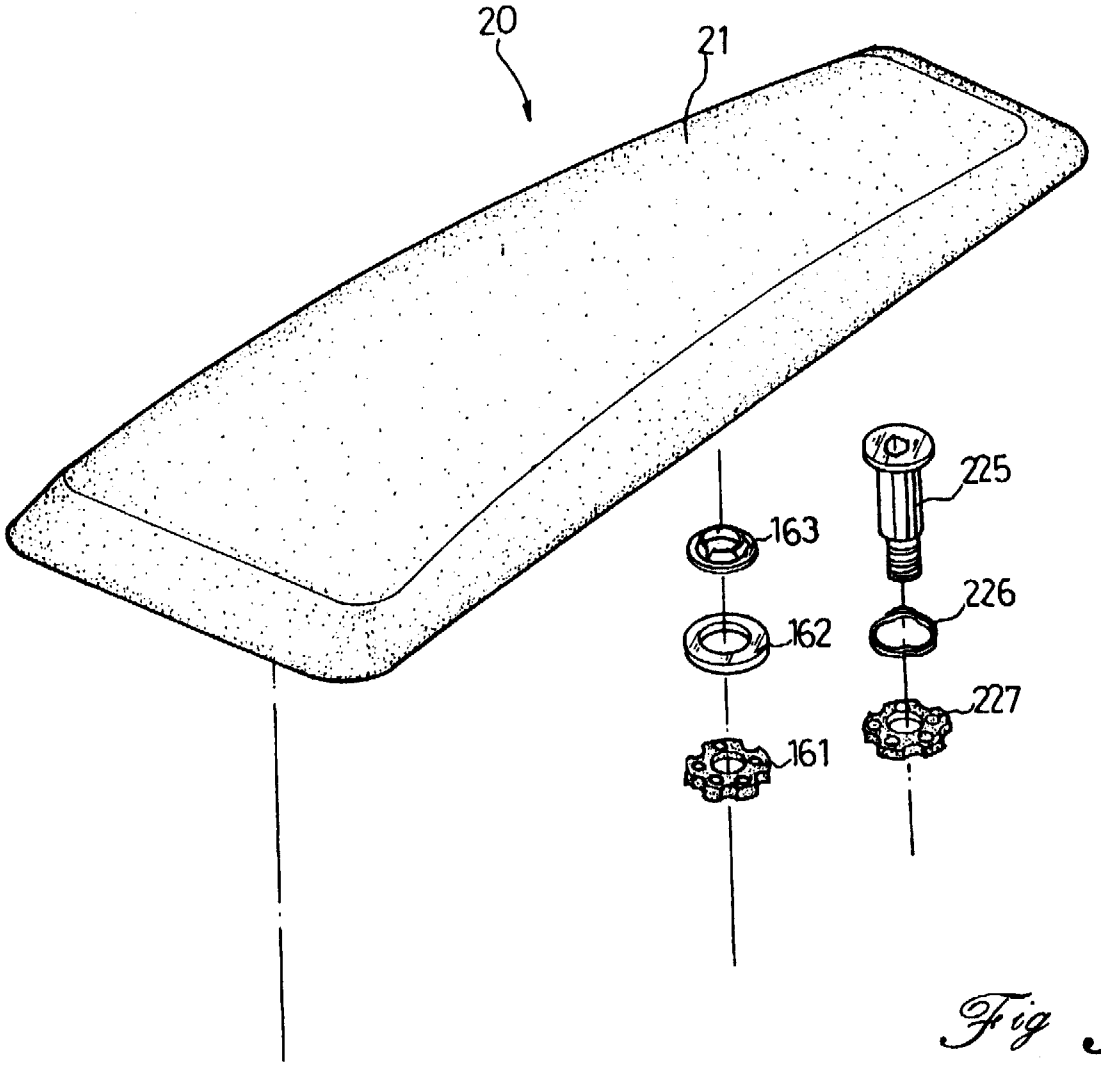
FIG. 3 is a perspective view of the upper lid and the associated element.

Referring to the drawings and initially to FIGS. 1 to 3, an armrest assembly in accordance with the present invention generally includes a base 30, a vertical post 10 adjustable relative to the base 30 in a vertical direction, and an armrest 20 mounted on top of the vertical post 10.

The vertical post 10 includes a first half post piece 11 and a second half post piece 12 which have symmetrically constructed outlines, best shown in FIG. 2. In this embodiment, the first half post piece 11 includes an arcuate slot 111 defined in an end of a top side thereof, and a receiving section 112 is defined adjacent to the arcuate slot 111. The top side of the first half post piece 11 further includes a stub 1121 formed thereon and communicated with the receiving compartment 112. A spring plate 119 is mounted to the receiving section 112 and is retained in position by the stub 1121. In addition, a hole 113 and a further receiving compartment 114 are provided to the other end of the top side of the first half post piece 11, best shown in FIG. 2, and a nut 115 is mounted in the compartment 114 and aligns with the hole 113.

The first half post piece 11 further includes two horizontal plates 115 and 116 formed on an inner side thereof and having a space 117 defined therebetween. Each plate 115, 116 includes a slot 1151, 1161 defined therein. A substantially U-shaped member 13 is mounted in the space 117, and a spring 133 is attached to between the member 13 and an inner periphery of the vertical post 10 to bias the member 13. In addition, a pin 132 is transversely extended through a through hole (not labeled) defined in the member 13. A control member 14 includes a button 141 mounted outside the vertical post 10 for manual operation and a pair of walls projecting from the button 141, each wall having a cavity 142, 143 defined in a distal end thereof for receiving the pin 132. A bolt 123 is extended through a hole 121 defined in the second half post piece 12 and a hole 118 defined in the first half post piece 11 to secure the post pieces 11 and 12 together.

Referring to FIGS. 2 and 3, the armrest 20 includes an upper lid 21 and a lower lid 22 which are secured together by means of extending bolts 224 through a hole 221 defined in the lower lid 22 and another hole (not shown) defined in the upper lid 21. The lower lid 22 includes two elongated slots 222 and 223 which are provided adjacent to each other, wherein the elongated slot 222 is inclined and then extends in a horizontal direction transverse to a longitudinal axis of the armrest 20. A first guide pin 16 is extended through the arcuate slot 111 and the elongated slot 222, and a resilient element 161, a washer 162, and a retaining element 163 (FIG. 3) are provided to the first sliding pin 16 to allow sliding movement of the sliding pin 16 relative to the elongated slot 222 and the arcuate slot 111. A second guide pin 225 (FIG. 3) is extended through the elongated slot 223 and includes a threaded end (not labeled) for engaging with the nut 15. A resilient member 227 and a washer 226 are provided to the guide pin 225 to allow relative sliding movements between the second guide pin 225 and the slot 223. Accordingly, the armrest 20 and the vertical post 10 are secured together, yet an adjustment of a horizontal position of the armrest 20 relative to the vertical post 10 is allowed, which will be described later.

Figure 4:
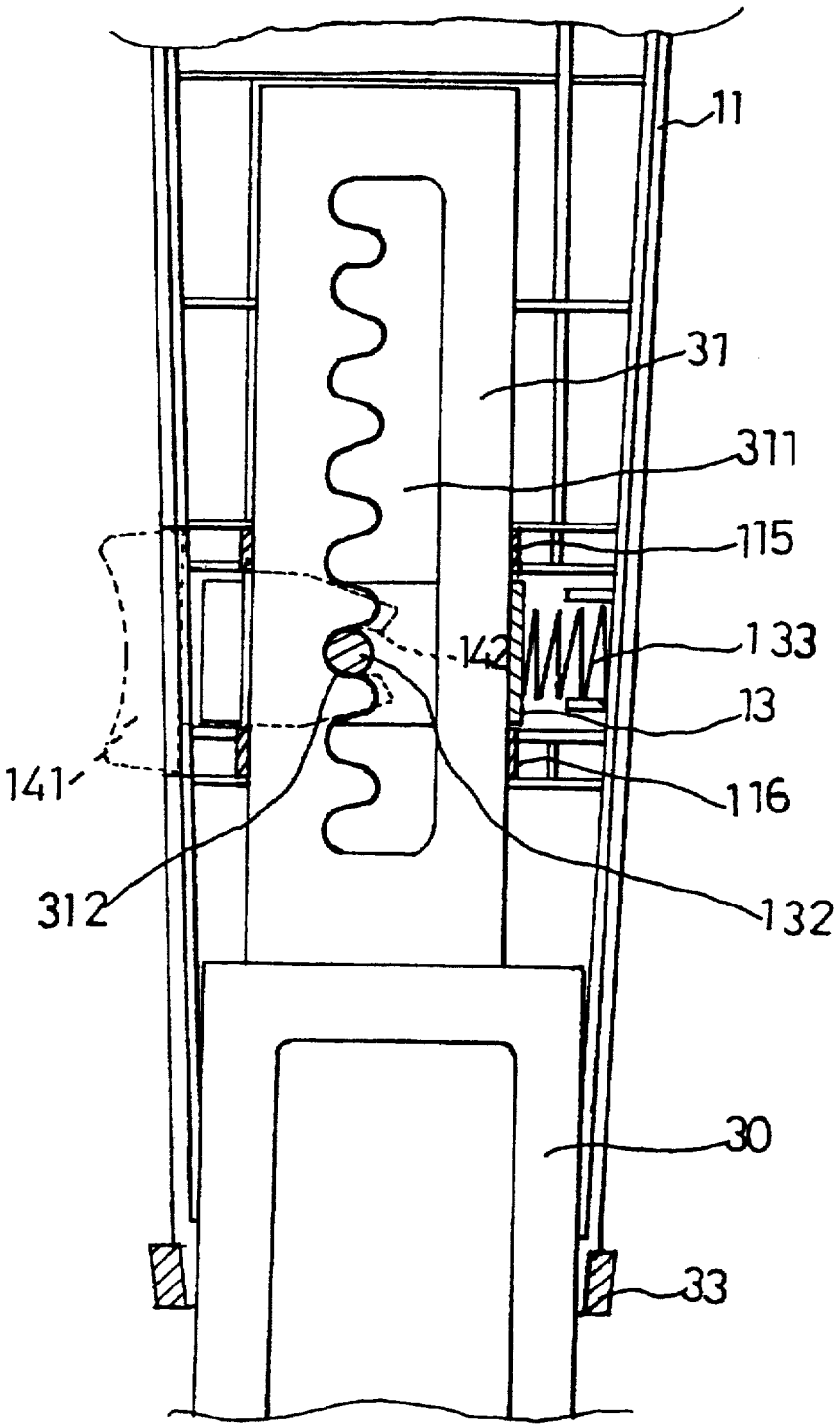
FIGS. 4 and 5 are schematic partial cross sectional views illustrating adjustment in the height of the armrest.
Figure 8:
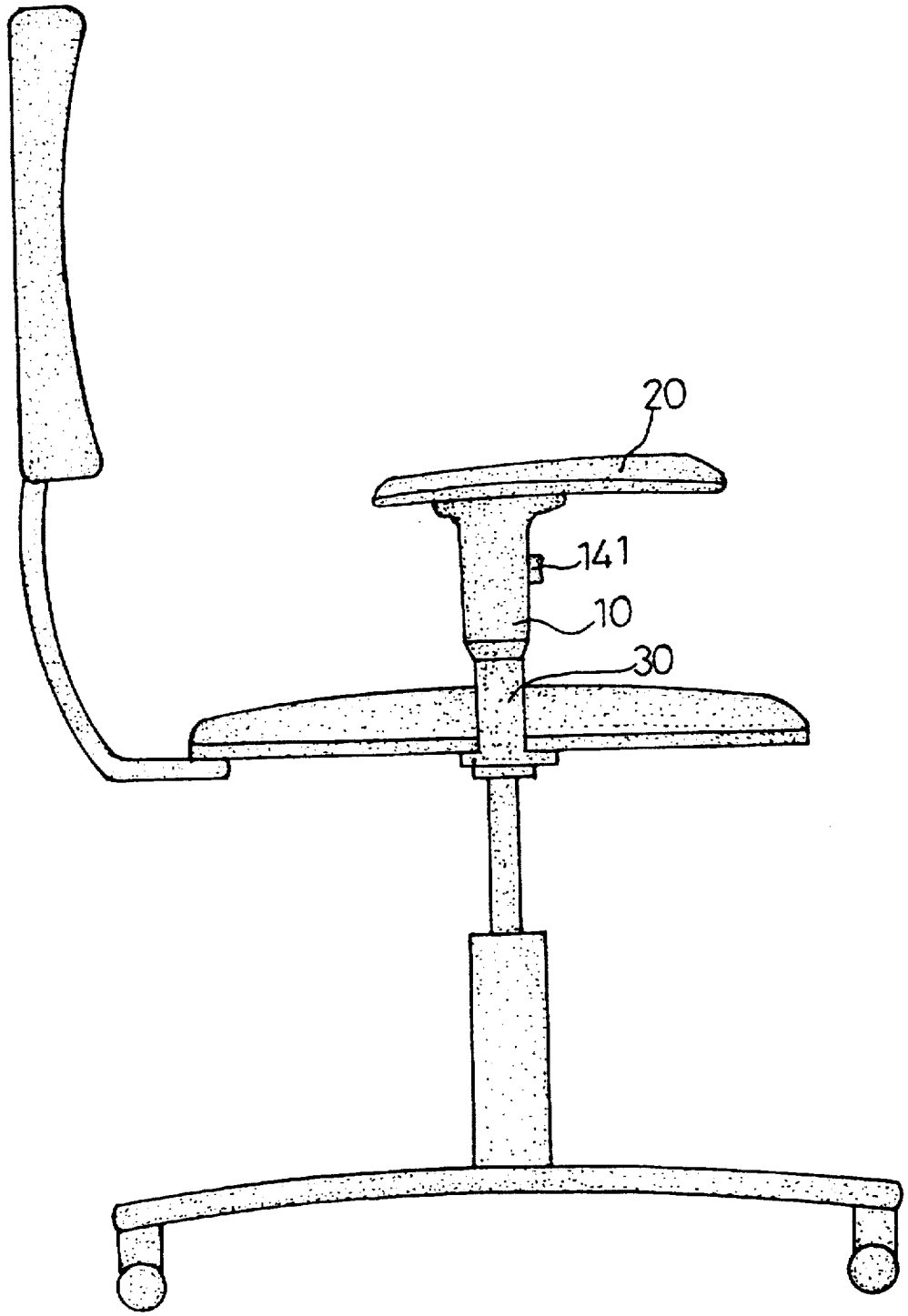
FIG. 8 is a side view of a chair equipped with the armrest assembly in accordance with the present invention.

The base 30 is substantially L-shaped and includes a lower end 32 secured to a chair frame (not labeled, see FIG. 8) and an upper end 31 having a slot 311. defined therein, wherein a number of protrusions are extended into the slot 311 to thereby provide a number of vertically spaced engaging grooves 312. The upper end 31 of the base 30 is extended through the slots 1161 and 1151 of the plates 115 and 116, as shown in FIG. 4, and the pin 132 is securely retained in one of the engaging grooves 312 under the action of the spring 133. In addition, as shown in FIG. 1, mounted between the vertical post 10 and the base 30 is an outer sleeve 33 includes a pair of snap fasteners 331 (FIG. 2) formed on an inner periphery thereof for engaging with the lower ends of the first and second post pieces 11 and 12.

Figure 5:
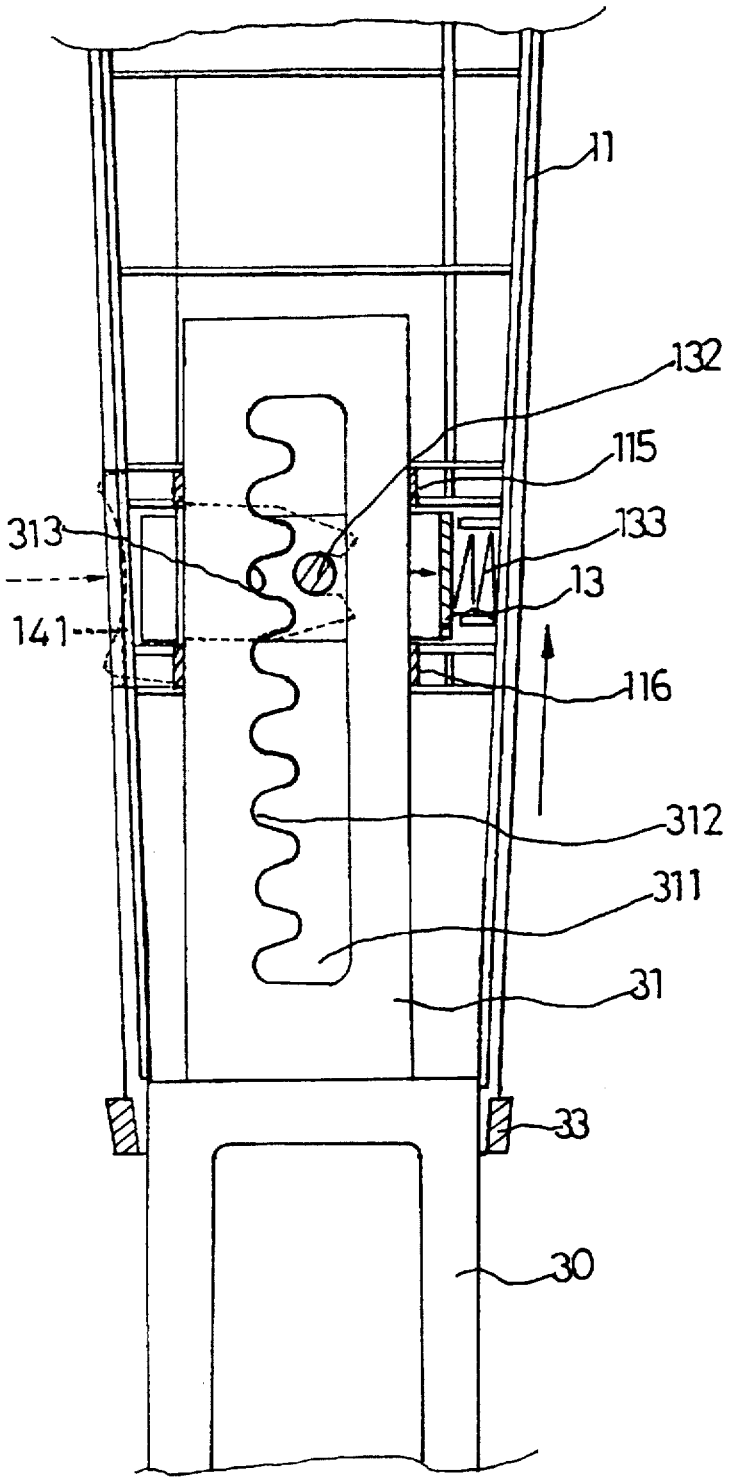

Referring to FIGS. 4 and 5, when adjustment of the height of the armrest 20 is required, the button 141 is pressed to overcome the spring force so as to move the pin 132 and the U-shaped member 13 to thereby disengage the pin 132 from the engaging groove 312. The armrest 20 and the vertical post 10 are then moved along the vertical direction to a desired height, and the button 141 is released such that the pin 132 engages with another engaging groove 313 (FIG. 5) under the action of the spring 133. Thus, the height of the armrest 20 can be easily, quickly adjusted.

Figure 6:
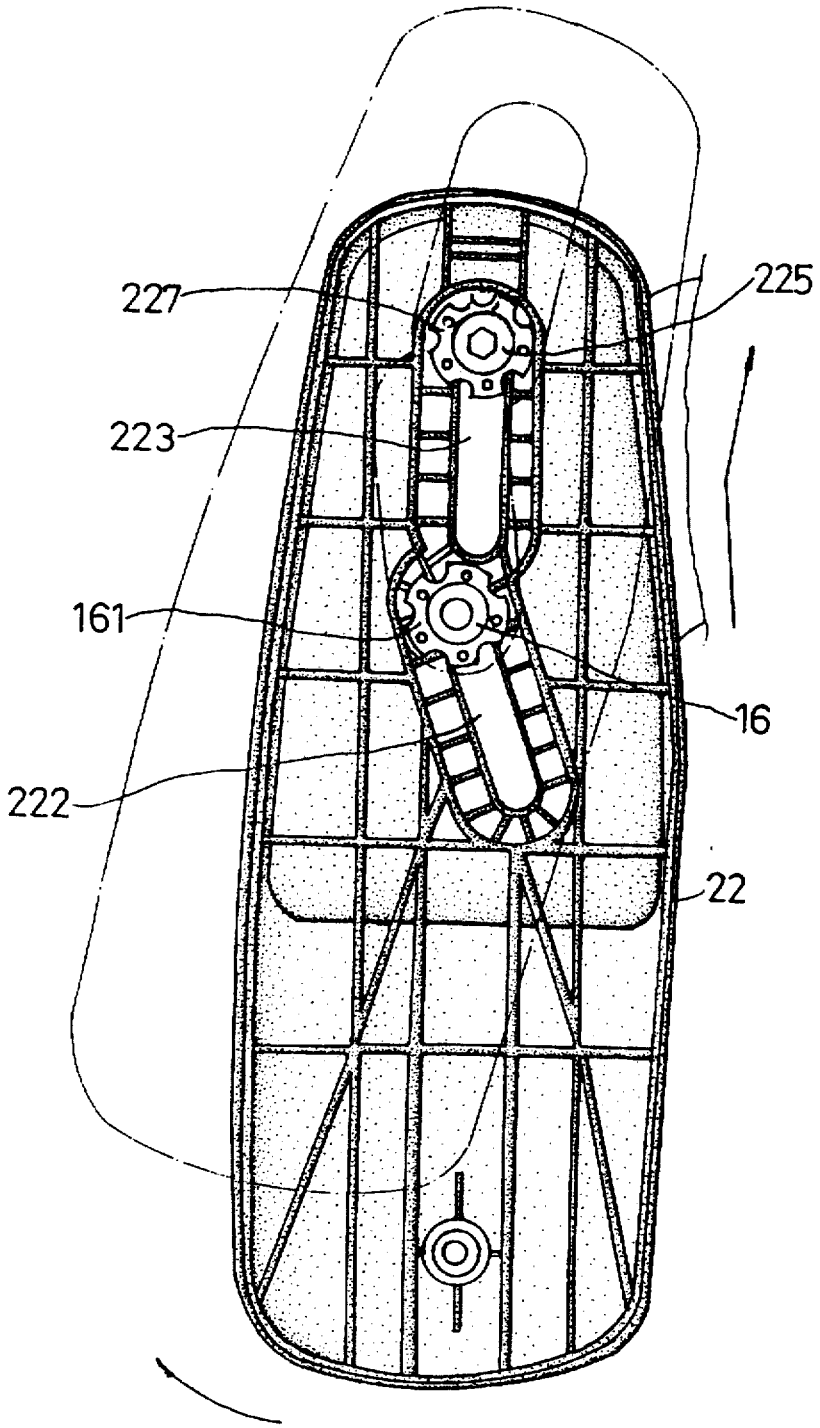
FIG. 6 is a top view illustrating horizontal adjustment of the armrest.

Referring to FIG. 6, the armrest 20 may be moved relative to the vertical post 10 in the horizontal direction. As shown in FIG. 6, the user may move the armrest 20, e.g., forwardly, i.e., from a position represented by the solid lines to another position represented by the phantom lines. Since the elongated slot 222 extends in a horizontal direction at an angle with the longitudinal axis of the armrest 20, the armrest 20 moves not only in the longitudinal direction but also in a transverse direction. This is advantageous in some cases, e.g., the user intends to use a keyboard (not shown) at a lower level rather than on the desk, he/she may adjust the armrests 20 to a position where the keyboard can be supported by the armrests 20. It is appreciated that inclination of the elongated slot 222 causes a change in the inclination angle of the armrest 20 when the armrest 20 is moved relative to the vertical post 10 guided by the guide pin 16.

Figure 7:
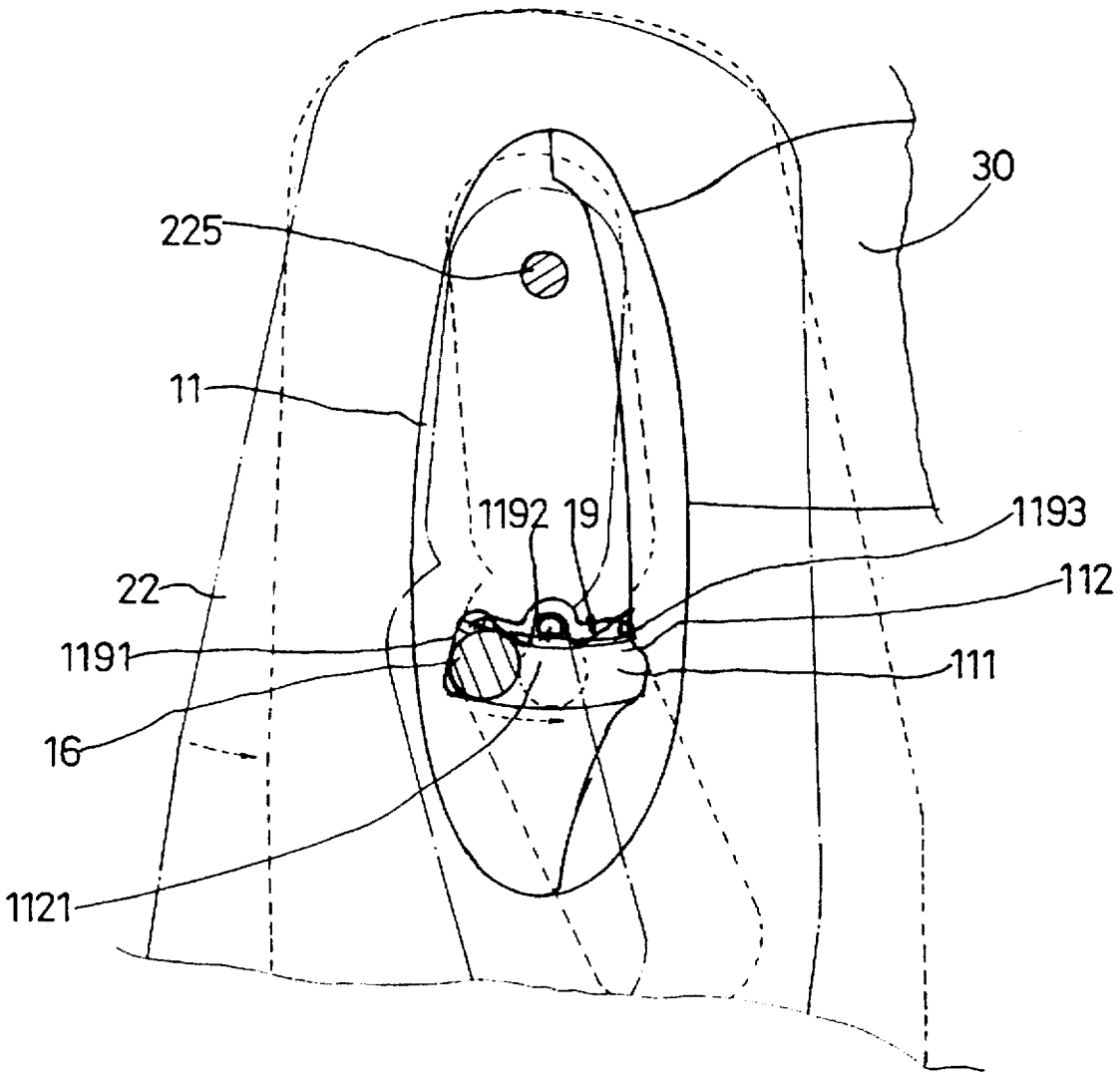
FIG. 7 is an enlarged view illustrating adjustment of a guide pin of the armrest.

Referring to FIGS. 7, the position of the first guide pin 16 can be adjusted, e.g., from a cavity 1191 defined in a side of the spring plate 119 (see the solid lines) to another cavity 1192 defined in a center of the spring plate 119 (see the phantom lines), such that the displacement of the armrest in the transverse direction becomes smaller. In this embodiment, the spring plate 119 includes three cavities 1191–1193 for engaging with the guide pin 16, in which the displacement of the armrest 20 in the transverse direction is the smallest when the guide pin 16 is shifted to the cavity 1193.

Figure 9:
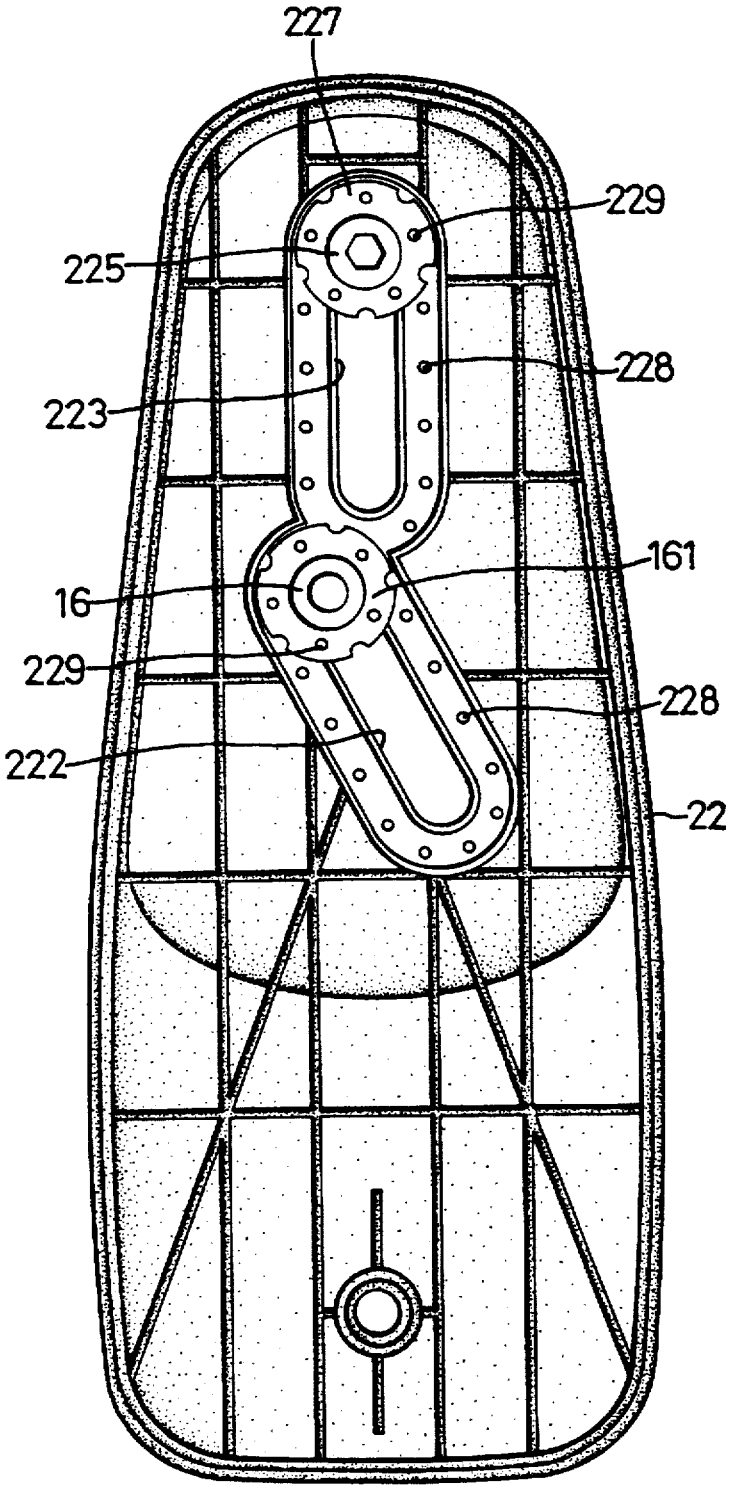
FIG. 9 is a top view of an armrest of a modified embodiment in accordance with the present invention.

FIG. 9 illustrates a modified embodiment, in which each guide slot 222, 223 includes a number of annularly spaced depressions 228 provided therearound, while each resilient member 227, 161 includes a number of annularly spaced knurls 229 formed on an underside thereof for releasably engaging with the depressions 228 such that the armrest 20 may be retained in any desired position relative to the vertical post 10.

According to the above description, it is appreciated that the armrest 20 of the present invention can be easily, quickly adjusted not only in the vertical direction but also in the horizontal direction (including the longitudinal direction and the transverse direction).

Although the invention has been explained in relation to its preferred embodiment, it is to be understood that many other possible modifications and variations can be made without departing from the spirit and scope of the invention as hereinafter claimed.

What is claimed is:

1. An armrest assembly for a chair, comprising:

a base including a lower end secured to the chair and an upper end, a vertical post mounted to the upper end of the base and adjustable in a vertical direction relative to the upper end of the base, the vertical post comprising at least one guide pin mounted thereto, and an armrest securely attached to the vertical post to move therewith in the vertical direction, the armrest including at least one elongated slot defined therein through which said at least one guide pin extends, said at least one slot being extended in a horizontal direction at an angle with a longitudinal axis of the armrest, whereby a sliding movement of the armrest relative to the vertical post causes the armrest to move in a longitudinal direction and a transverse direction on a horizontal plane on which the armrest locates.

2. The armrest assembly according to claim 1, wherein said at least one elongated slot is inclined.

3. The armrest assembly according to claim 1, wherein the upper end of the base includes a plurality of vertically spaced engaging grooves defined therein, and the vertical post includes a pin mounted therein for releasably engaging with one of said plurality of engaging grooves, and a control means is provided to actuate the pin to disengage from the engaging grooves.

4. The armrest assembly according to claim 1, wherein the vertical post comprises an outer sleeve attached to a lower end thereof.

5. An armrest assembly for a chair, comprising:

a base including a lower end secured to the chair and an upper end, the upper end of the base including a plurality of vertically spaced engaging grooves defined therein, a vertical post mounted to the upper end of the base and adjustable in a vertical direction relative to the upper end of the base, the vertical post including a pair of horizontal plates which together define a space therebetween, each said plate including a slot defined therein through which the upper end of the base extends, a control member including a button mounted outside the vertical post for manual operation and a pair of walls projecting from the button into the space, each said wall having a cavity defined in a distal end thereof for receiving a pin, a U-shaped member being mounted in the space, the pin being transversely extended through the U-shaped member to move therewith, and a spring being attached between the U-shaped member and the vertical post to bias the pin to engage with one of said plurality of engaging grooves, and an armrest securely attached to the vertical post to move therewith in the vertical direction, said pin being disengaged from the engaging grooves to allow vertical movements of the vertical post and the armrest relative to the base when the button is pressed.

6. An armrest assembly for a chair, comprising:

a base including a lower end secured to the chair and an upper end, a vertical post mounted to the upper end of the base and adjustable in a vertical direction relative to the upper end of the base, the vertical post comprising at least one guide pin mounted thereto, and an armrest securely attached to the vertical post to move therewith in the vertical direction, the armrest including at least one elongated slot defined therein through which said at least one guide pin extends, said at least one slot being extended in a horizontal direction at an angle with a longitudinal axis of the armrest, whereby a sliding movement of the armrest relative to the vertical post causes the armrest to move in a longitudinal direction and a transverse direction on a horizontal plane on which the armrest locates, wherein the vertical post includes a slot defined in a top side thereof, and said at least one guide pin is slidably extended through the slot, and a spring plate is mounted on the top side of the vertical post and includes at least two positions for releasably engaging with said at least one guide pin, wherein when said at least one guide pin is retained in one of said at least two positions, a maximum displacement in the transverse direction of the armrest during movement of the armrest relative to the vertical post is different from that of the armrest when said at least one guide pin is retained in the other of said at least two positions.

7. An armrest assembly for a chair, comprising:

a base including a lower end secured to the chair and an upper end, a vertical post mounted to the upper end of the base and adjustable in a vertical direction relative to the upper end of the base, the vertical post comprising at least one guide pin mounted thereto, and an armrest securely attached to the vertical post to move therewith in the vertical direction, the armrest including at least one elongated slot defined therein through which said at least one guide pin extends, said at least one slot being extended in a horizontal direction at an angle with a longitudinal axis of the armrest, whereby a sliding movement of the armrest relative to the vertical post causes the armrest to move in a longitudinal direction and a transverse direction on a horizontal plane on which the armrest locates, wherein the upper end of the base includes a plurality of vertically spaced engaging grooves defined therein, and the vertical post includes a pin mounted therein for releasably engaging with one of said plurality of engaging grooves, and a control means is provided to actuate the pin to disengage from the engaging grooves, wherein the vertical post includes a pair of horizontal plates which together define a space therebetween, each said plate includes a slot defined therein through which the upper end of the base extends, and the control member includes a button mounted outside the vertical post for manual operation and a pair of walls projecting from the button into the space, each said wall has a cavity defined in a distal end thereof for receiving the pin, and a spring is provided to bias the pin to engage with said one of said plurality of engaging grooves.

8. The armrest assembly according to claim 7, wherein a U-shaped member is mounted in the space, the pin is transversely extended through the U-shaped member to move therewith, and the spring is attached between the U-shaped member and an inner periphery of the vertical post.

9. The armrest assembly according to claim 7, wherein the vertical post includes two half post pieces which are secured together, and the horizontal plates are provided on an inner side of one of the two half post pieces.

* * * * *